US006053466A

United States Patent [19]

Jordan et al.

[11] Patent Number: 6,053,466

[45] Date of Patent: Apr. 25, 2000

[54] PALLET WITH FLEXIBLE TENSILE REINFORCEMENT

[75] Inventors: Richard Alan Jordan; John Edward Yestrepsky, both of Clinton Township; Raymond H. Gosnell, Plymouth; Richard George Brooks, Sterling Heights, all of Mich.

[73] Assignee: Cadillac Products, Inc., Sterling Heights, Mich.

[21] Appl. No.: 09/086,845

[22] Filed: May 29, 1998

Related U.S. Application Data

[63] Continuation-in-part of application No. 08/561,029, Nov. 21, 1995, Pat. No. 5,758,855.

[51] Int. Cl.[7] ..... A47B 91/00

[52] U.S. Cl. ..... 248/346.01; 248/346.02; 108/57.24

[58] Field of Search ..... 248/346.02, 346.01, 248/678, 903; 108/57.25, 57.26, 57.28, 56.3, 901, 902; 52/309.15, 309.16, 223.6

[56] References Cited

U.S. PATENT DOCUMENTS

| | | | |
|---|---|---|---|
| 1,698,038 | 1/1929 | Warshaw et al. | 108/57.24 |
| 1,770,614 | 7/1930 | Hennessy | 108/57.25 |
| 3,187,688 | 6/1965 | Kreilick | 108/57.32 |
| 3,247,810 | 4/1966 | Sepe et al. | 108/53.3 |
| 3,444,034 | 5/1969 | Hewett | 156/196 X |
| 3,604,368 | 9/1971 | Baxter | 108/53.1 |
| 3,610,172 | 10/1971 | Wharton | 108/21 |
| 3,667,403 | 6/1972 | Angelbeck, Jr. | 108/57.26 |
| 3,696,761 | 10/1972 | Brown | 108/53.3 |
| 3,717,922 | 2/1973 | Witkowski | 29/421.1 |
| 3,868,915 | 3/1975 | Hafner | 108/57.26 |
| 3,882,651 | 5/1975 | Gilchrist | 52/223.6 |
| 3,925,140 | 12/1975 | Brown | 156/382 |
| 4,159,681 | 7/1979 | Vandament | 108/57.33 |
| 4,586,303 | 5/1986 | Jartoux et al. | 52/309.16 |
| 4,735,154 | 4/1988 | Hemery | 108/56.1 |
| 4,879,956 | 11/1989 | Shuert | 108/53.3 |
| 5,042,396 | 8/1991 | Shuert | 108/57.25 |
| 5,108,529 | 4/1992 | Shuert | 156/214 |
| 5,117,762 | 6/1992 | Shuert | 108/57.25 |
| 5,197,396 | 3/1993 | Breezer et al. | 108/56.3 |
| 5,255,613 | 10/1993 | Shuert | 108/52.1 |
| 5,391,251 | 2/1995 | Shuert | 156/292 |
| 5,401,347 | 3/1995 | Shuert | 156/245 |
| 5,404,829 | 4/1995 | Shuert | 108/57.26 |
| 5,407,632 | 4/1995 | Constantino et al. | 264/545 |
| 5,408,937 | 4/1995 | Knight, IV et al. | 108/55.5 |
| 5,549,056 | 8/1996 | Jordan et al. | 108/57.25 |
| 5,758,855 | 6/1998 | Jordan et al. | 248/346.01 |

*Primary Examiner*—Leslie A. Braun
*Assistant Examiner*—Gwendolyn Baxter
*Attorney, Agent, or Firm*—Brooks & Kushman P.C.

[57] ABSTRACT

A reinforced pallet (20) and method for making the same are disclosed. The pallet (20) includes a body (28) having a pair of laterally spaced apart edge portions (56) with a central span (60) extending therebetween. A flexible tensile member (26) extends between the edge portions (56) and generally beneath the central span (60). The tensile member (26) may be in the form of a mesh affixed between upper and lower decks (22,24) of the pallet (20). When the edge portions (56) of the pallet (20) are simply supported and a load is place atop the pallet (20), the central span (60) of the pallet (20) will vertically deflect in response to the load. The central span (60) will bear upon the tensile member (26) with the tensile member providing support against deflection. A method for retrofitting a pallet (200) includes adding a tensile member (210) to the pallet (200) to reduce the amount of deflection of the pallet (200) when simply supported in response to a load placed atop the pallet (200).

7 Claims, 7 Drawing Sheets

PALLET WITH FLEXIBLE TENSILE REINFORCEMENT

RELATED APPLICATION

This application is a continuation-in-part of U.S. application Ser. No. 08/561,029 filed Nov. 21, 1995, now U.S. Pat. No. 5,758,855.

INCORPORATION BY REFERENCE

The disclosure of U.S. Ser. No. 08/220,965, entitled Load Distributor For Pallets, filed Mar. 31, 1994, is hereby incorporated by reference in its entirety.

TECHNICAL FIELD

This invention relates to reinforced plastic pallets.

BACKGROUND ART

Pallets made of thermoplastic materials are rapidly replacing old wood-type pallets. The plastic pallets have been proven to be lightweight, resilient, inexpensive to manufacture, and can easily be configured in different shapes due to their molded construction.

One disadvantage that plastic pallets have relative to wood pallets is that the plastic pallets are more susceptible to creep. Even at relatively low temperatures, such as 80° F. to 120° F., the permanent deformation of the plastic pallets under load can be significant.

Pallets are often stacked one atop another resulting in primarily compressive loading. In other instances, pallets may be stored in racks. The racks have opposing ledges upon which laterally spaced edge portions of the pallets are placed. Accordingly, the central spans of the pallets are left unsupported. If the temperature in the surroundings in which the pallets are stored becomes sufficiently high, and the pallets are kept on the racks for an extended period of time with heavy loads thereon, these pallets can exhibit significant deformation due to creep. Consequently, the center of the pallets may sag downwardly with the laterally spaced and supported edge portions moving inboard toward one another. If the edge portions move sufficiently inboard, the edge portions may slip from the rack with the pallet falling therefrom.

One solution to this sagging and creep problem for edge or simply supported pallets is to provide rigid steel bar reinforcements in the pallets to reduce the amount of sag. The steel bars use their inherent structural rigidity to act as beams resisting vertical deflection due to the vertical loads placed on the pallet. The rigid reinforced pallets thereby decrease the overall amount of sag or vertical deflection as compared to a pallet without the reinforcement.

However, pallets with the rigid reinforced steel bars therein have a number of shortcomings. A first problem is that the steel bars can become permanently deformed thus permanently deforming the overall pallets. Occasions where steel reinforcement bars may become bent include when the pallets are dropped, run over by a truck or other vehicle or else run into by a forklift. In these cases, the steel bars and surrounding pallets may have permanent, and often undesirable, deformations formed therein.

Another problem is that using thick steel bars with substantial cross-sectional area to provide stiffness against lateral deflection or bending also significantly increases the overall weight of the pallet. One of the chief advantages of using plastic pallets is that they are lightweight. Hence, using thick steel bars offsets this advantage.

An additional problem associated with insert molding rigid steel bars within pallets is that the steel bars have a propensity to work their way through the plastic. Ends of the rigid bars can then protrude through external surfaces of the pallets. The protruding bars may snag objects or make otherwise flush surfaces bulge.

The present invention is intended to minimize the shortcomings associated with pallets which are reinforced with rigid steel bars.

DISCLOSURE OF INVENTION

A reinforced pallet and method for making the same are disclosed. The pallet includes a body having an upper surface and a pair of laterally spaced-apart edge portions. A pair of attachment points are spaced from the upper surface adjacent the pair of edge portions, respectively. A central support portion is spaced from the upper surface between the attachment points. A flexible tensile member is secured at opposing distal ends thereof to the pair of attachment points and is substantially unrestrained therebetween to allow movement for tension and flexion. The term "substantially unrestrained" as used in this description means that the flexible tensile member is attached at no more than a few locations along its length; preferably attached only at its opposing ends. When a load is placed atop the pallet with the pallet being supported along the pair of laterally spaced apart edge portions, the central support portion will deflect and bear upon the flexible tensile member with the flexible tensile member providing support to the central support portion against deflection.

It is an object of the present invention to provide a pallet or the like which is reinforced to minimize sagging or deflection and which is resilient against permanent deformation.

It is another object to provide elongate flexible tensile members in a plastic pallet which provide reinforcement against sagging while not being susceptible to permanent deformation laterally about their longitudinal axes.

It is yet another object to provide a pallet with an adjustable tensioner and a flexible tensile member in which the tension can be adjusted to control the amount of deflection of the pallet in response to a load of a predetermined magnitude.

A further object is to provide a pallet with a flexible tensile member which is easily mounted and dismounted relative to the body of the pallet.

BRIEF DESCRIPTION OF THE DRAWINGS

These and other features, objects and advantages of the present invention will become readily apparent from the following description, pending claims, and accompanying sheets of drawings where:

BEST MODES FOR CARRYING OUT THE INVENTION

Figure 1:
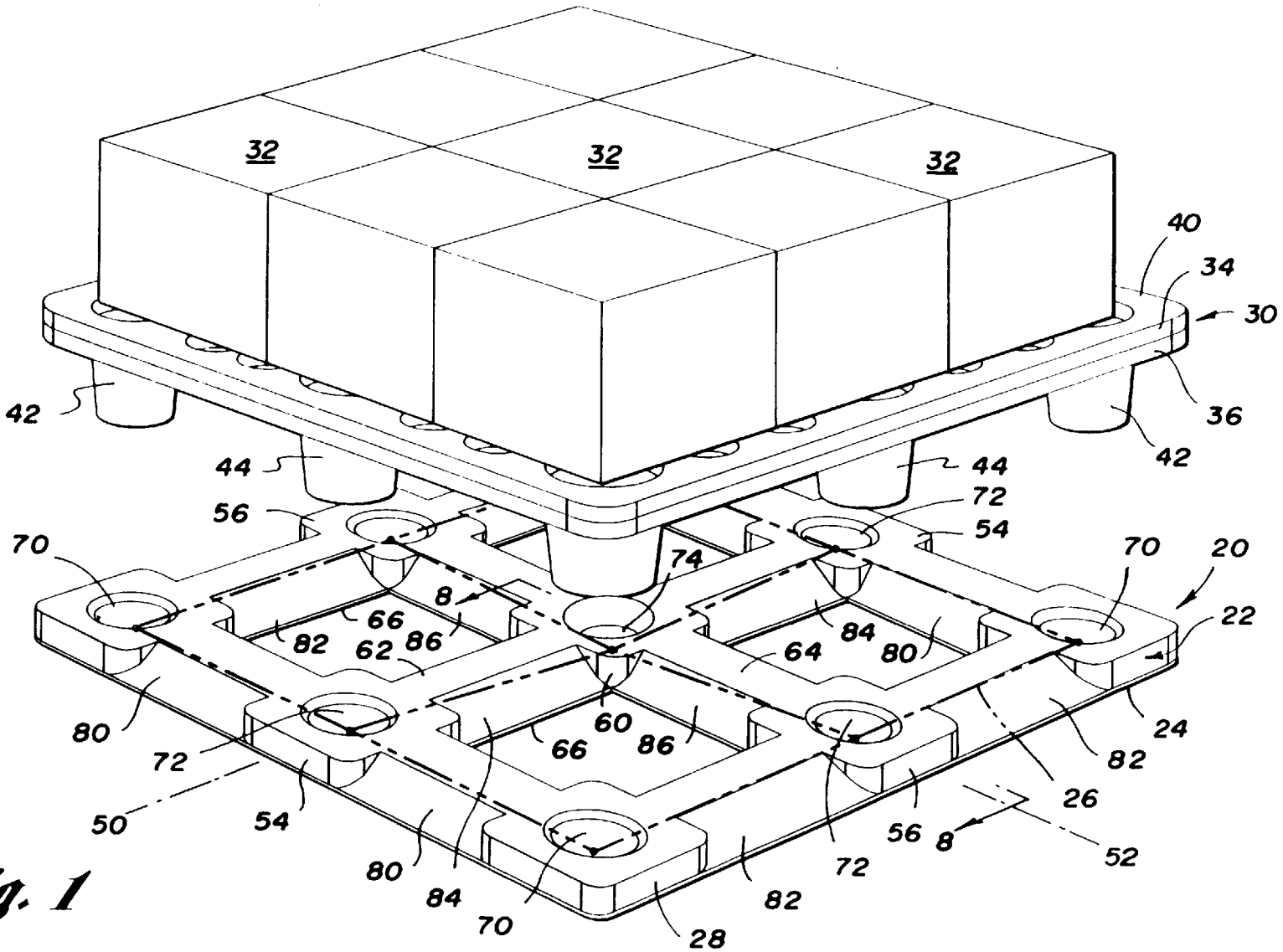
FIG. 1 is an exploded perspective view of a load pallet with objects thereon disposed above a reinforced distributor pallet made in accordance with the present invention.

A load distributor pallet 20, made in accordance with a first embodiment of the present invention, is shown in FIG. 1. Distributor pallet 20 comprises an upper deck 22, a lower deck 24 and a flexible tensile member or mesh 26 disposed therebetween. Preferably, both upper and lower decks 22 and 24 are made of a thermoplastic resin material such as a high density polyethylene. Heated sheets of the polyethylene are vacuum formed and fused together using a twin-sheet thermoforming process, such as described in U.S. Pat. No. 3,925,140, to form a combined plastic body 28. Further details regarding the molding of distributor pallet 20 will be described below. Decks 22 and 24 of body 28 are joined at numerous discrete engineered fusion or knit points.

Located above distributor pallet 20 is a load pallet 30 upon which boxes 32 or other objects may be stacked. Preferably, load pallet 30 has an upper deck 34 and a lower deck 36 which are joined in a twin-sheet thermoforming process. Upper deck 34 has a generally planar upper surface 40 upon which boxes 32 can flushly rest.

Load pallet 30 has nine downwardly depending hollow legs including four corner legs 42, four intermediate legs 44 and a central leg 46 (not shown in FIG. 1). Legs 44 are located between the corner legs 42 along the periphery of load pallet 30. Legs 42, 44 and 46 rest upon distributor pallet 20 and provide a space between distributor pallet 20 and load pallet 30 into which forks of a forklift can be received.

Body 28 of distributor pallet 20 is generally rectangular in configuration and symmetrical about respective longitudinal and lateral axes 50 and 52. Body 28 has a rectangular periphery which includes edge portions 54 which are longitudinally spaced apart and edge portions 56 which are laterally spaced apart. A cross-shaped central span 60 has a central longitudinally extending beam portion 62 and a central laterally extending beam portion 64 which are generally trapezoidal in shape and intersect with one another at the center of central span 60. Four rectangular openings 66 are defined between the edge portions 54 and 56 and crossing beam portions 62 and 64.

Formed in the upper surface of upper deck 22 are four recessed blocks 70, four intermediate recessed blocks 72 and a central recessed block 74. Recesses in blocks 70, 72 and 74 are ideally shaped to snugly receive respective legs 42, 44 and 46 of load pallet 30. Edge portions 54 and 56 include respective ramped surfaces 80 and 82. Similarly, beam portions 62 and 64 have ramped surfaces 84 and 86. These ramped surfaces on distributor pallet 20 allow for wheels of a pallet jack to cross over upper deck 22 and access openings 66.

When distributor pallet 20 is supported in a rack, central span 60 is suspended between either of edge portions 54 or edge portions 56. With load pallet 30 placed atop distributor pallet 20, the load exerted from boxes 32 will pass from load pallet 30 and is received in distributor pallet 20. The unsupported central span 60 will tend to sag downwardly relative to the supported edge portion 54 or 56 due this load. Flexible tensile member 26 within distributor pallet 20 provides reinforcement to body 28 to reduce this sag and to relieve bending stress placed on body 28.

As used herein, the term "flexible tensile member" refers to members which have large axial tensile strength while having little, if any, compressive axial or columnar strength. Therefore, these flexible tensile members can be significantly laterally displaced relative to their longitudinal axes without incurring permanent deformation as would a stiff column or beam.

Figure 2:
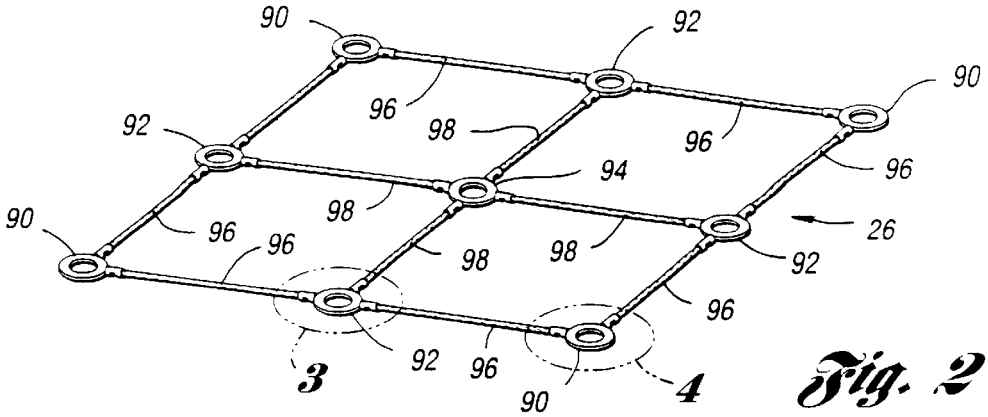
FIG. 2 is a perspective view of a cable mesh which is to be molded within the distributor pallet of FIG. 1.

Flexible tensile member 26 is shown in greater detail in FIG. 2. In the embodiment of FIG. 1, tensile member 26 is a cable mesh. Tensile member 26 includes corner rings 90, intermediate rings 92 and a central ring 94. Connecting between rings 90 and 92 are outer cables 96 and between rings 92 and central ring 94 are inner cables 98. Preferably, cables 96 and 98 are made of steel to provide a high modulus of elasticity (30,000,000 psi) and great resistance to axial elongation. However, it is contemplated that other materials may serve to form cables such as Nylon or fiberglass reinforced plastic.

Figure 3:
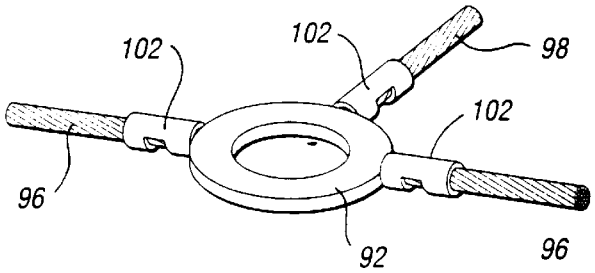
FIG. 3 is an enlarged fragmentary view of the encircled area 3 of FIG. 2.

FIG. 3 shows an exemplary retaining ring 92. Ring 92 has three crimping collars 102 into which the ends of cables 96 and 98 are placed. Crimping collars 102 are crimped to secure the ends of cables 96 and 98. Rings 90 have two crimping collars 102 while central ring 94 includes four crimping collars 102.

Figure 4:
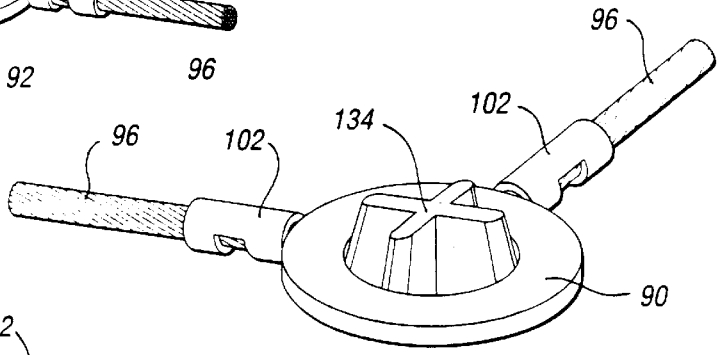
FIG. 4 is an enlarged fragmentary view of the encircled area 4 of FIG. 2 showing a retaining ring mounting over a peripheral post of the distributor pallet.
Figure 5:
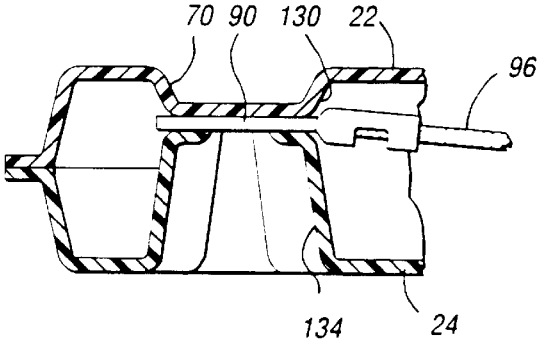
FIG. 5 is a fragmentary side sectional view showing a retaining ring of the cable mesh mounting over a peripheral post and captured between upper and lower decks comprising the distributor pallet.

FIG. 4 shows a ring 90 mounting over an upwardly protruding peripheral post 134 which is formed on lower deck 24. Peripheral post 134 has a stepped upper periphery which is X-shaped in cross-section. FIG. 5 shows, in cross-section, an exemplary ring 90 mounting over a peripheral post 134. A downwardly depending post 130, formed on upper deck 22, cooperates with post 134 to retain ring 90. The overall layout of posts formed by upper deck 22 and lower deck 24 will be described below in reference to FIGS. 8 and 9.

Figure 6:
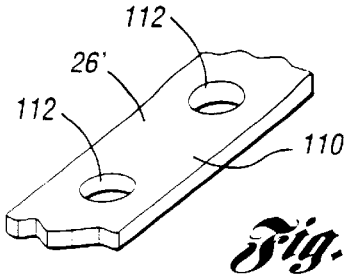
FIG. 6 is a fragmentary perspective view of a strap which may be used in place of a cable as a flexible tensile member.

As an alternative to steel cables 96 and 98, high tensile strength plastic straps or bands 110, depicted in FIG. 6, may be used as flexible tensile members 26' in this invention. Apertures 112 are provided in tensile member 26'. These apertures 112 provide openings such that when upper and lower decks 22 and 24 are joined about tensile member 26', knit points which extend through apertures 112 can be created between decks 22 and 24.

Figure 7:
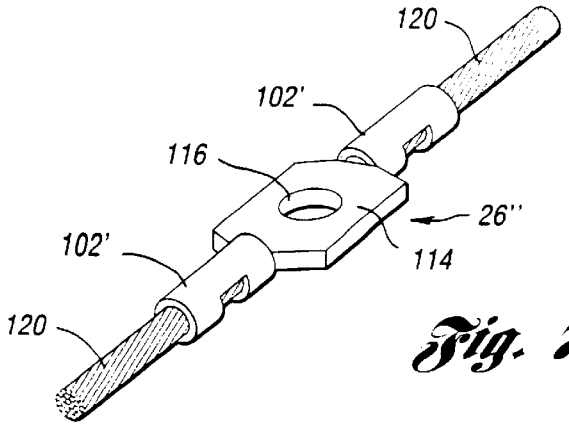
FIG. 7 is a fragmentary view of a cable with an intermediate plate located therein.

Another potential embodiment for use as a tensile member is tensile member 26", shown in FIG. 7. A plate 114, having an aperture 116 therein, utilizes crimping collars 102' to secure cables 120 thereto. Again, aperture 116 may serve to provide access for creating a knit point between upper and lower decks which are being joined together.

Figure 8:
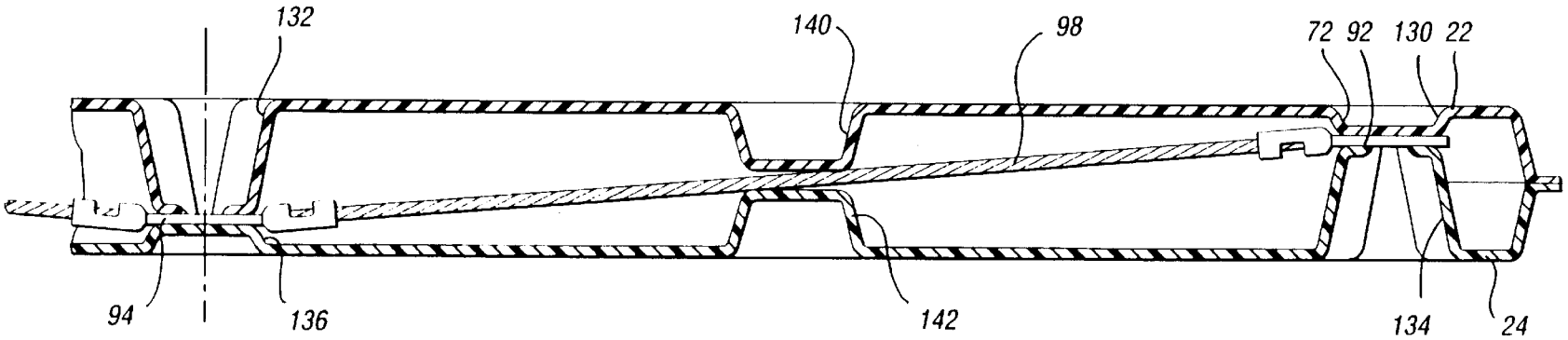
FIG. 8 is a fragmentary sectional view of a distributor pallet, similar to the distributor pallet of FIG. 1, illustrating upper and lower decks with a flexible tensile member captured therebetween.

FIG. 8 shows a fragmentary sectional view which is similar to that which would appear along line 8—8 of FIG. 1, with minor modifications. Upper sheet 22 is shown with a downwardly extending peripheral post 130 and a downwardly extending central post 132. Similarly, lower sheet 24 has an upwardly extending peripheral post 134 and a central post 136. As distributor pallet 20 is generally symmetrical about both longitudinal and lateral axes 50 and 52, there are a total of eight sets of opposing peripheral posts 130 and 134 and one set of opposing central posts 132 and 136. The peripheral posts 130 and 134 are located at the corners and midway along the edges of distributor pallet 20. Four sets of middle posts 140 and 142 (not incorporated in the distributor pallet of FIG. 1) are formed in respective upper and lower decks 22 and 24 to further restrain cable 98 between the edges and center of distributor pallet 20. The posts are all generally cylindrically shaped and taper slightly inboard toward their distal ends.

In a free state, flexible tensile member or mesh 26 is sized to lie generally in a plane with corner and intermediate rings 90 and 92 mounting atop corresponding peripheral posts 134 and with central ring 94 being suspended above central post 136. Accordingly, peripheral posts 134 on lower deck 24 extend upwardly to near the top of distributor pallet 20 while central post 136 is kept quite short. This allows tension to be placed across inner cables 98 when central ring 94 is displaced from the plane defined by the tops of peripheral posts 134. Complementary peripheral posts 130 on upper deck 22 are kept short while center post 132 is significantly longer to mate with the short central post 136. During manufacture, central ring 94 and central post 132 are pressed into engagement with center post 136 thereby tensioning cables 98. Cables 98 will then extend diagonally rather than remaining in the plane defined by the tops of peripheral posts 134.

Figure 9:
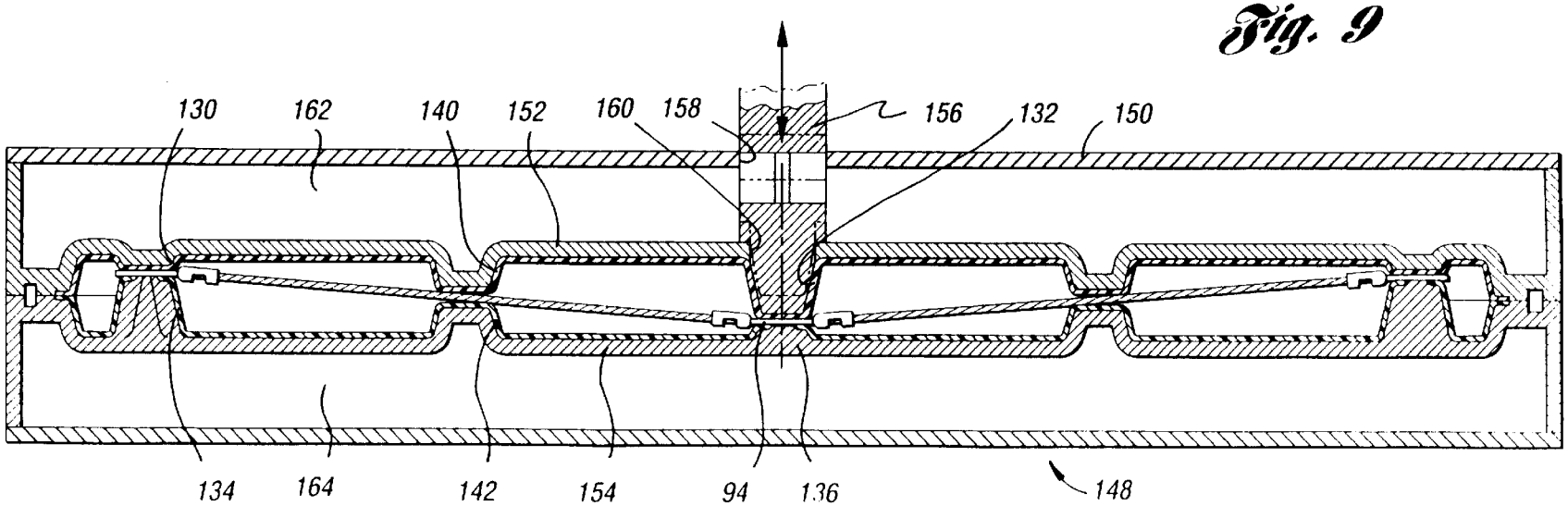
FIG. 9 is a fragmentary view of the distributor pallet of FIG. 8 in a forming mold having an actuatable mold pin used to depress and position a central retaining ring thereby tensioning the cable mesh during molded construction of the distributor pallet.
Figure 14:
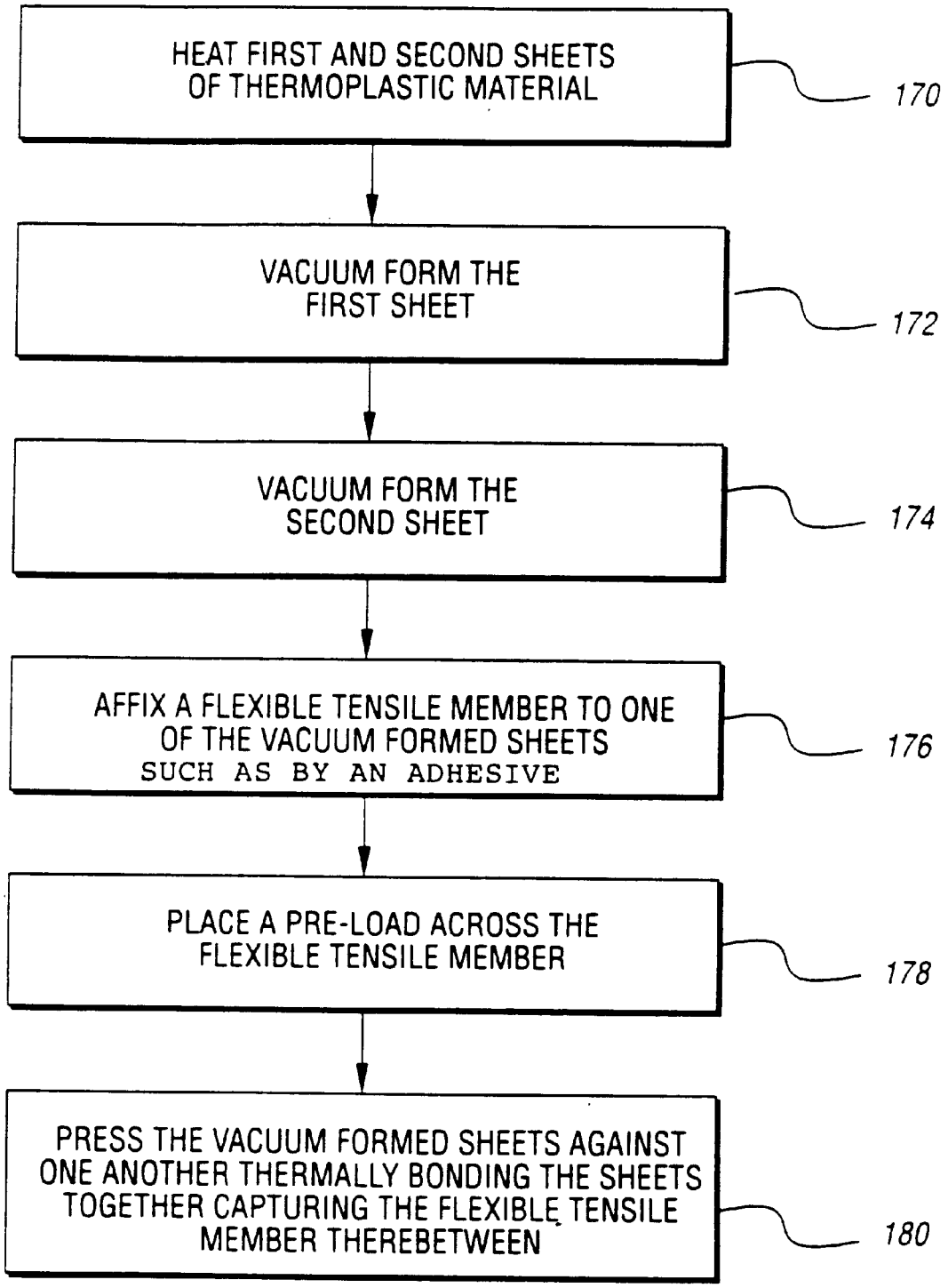
FIG. 14 is a block diagram summarizing steps taken in manufacturing the distributor pallet.

FIG. 9 shows a sectional view of distributor pallet 20 being formed in a mold. FIG. 14 provides a flowchart of steps utilized in making distributor pallet 20. A twin-sheet thermoforming device 148 is used to create distributor pallet 20. The device includes an air-tight outer aluminum housing 150 in which a vacuum may be developed. Inside housing 150 is an upper mold 152 and a lower mold 154. A translatable mold pin 156 passes through an opening 158 in aluminum housing 150 and an opening 160 in upper mold 152 to assist in the formation of central post 132. Upper and lower vacuum chambers 162 and 164 are created between housing 150 and respective upper and lower molds 152 and 154. Manufacturing steps 170–180 are summarized in FIG. 14.

In operation, a first thermoplastic sheet is placed in thermoforming device 148 and heated. Subsequently, a second sheet of thermoplastic is placed in device 148. After the temperature of the first sheet has risen to approximately 300–320° F. the first sheet is placed over lower mold 154. A vacuum is applied across lower vacuum chamber 164 with the first sheet being vacuum formed into the configuration of lower deck 24. Next, the second sheet of thermoplastic, after being sufficiently heated, is placed beneath upper mold 152. A vacuum is applied across upper vacuum chamber 162 with the second sheet being generally vacuum formed to the configuration of upper deck 22. However, mold pin 156 is only partially actuated and central post 132 extends only partially toward opposing central post 136.

Housing 150 is opened and a robot (not shown) transports flexible tensile member or mesh 26 into housing 150 and places rings 90 and 92 atop peripheral posts 134 of lower deck 24. Upper deck 22 is then pressed down upon lower deck 24 with a plurality of knits points being formed therebetween. Residual heat and pressure integrally fuse upper and lower decks 22 and 24 about their perimeters, at opposing posts, and other discrete locations creating knit points.

Actuating mold pin 156 is further extended stretching central post 136 downwardly and causing central ring 94 to be placed adjacent to central post 136 of lower deck 24. As central ring 94 is lowered, tensile member 26 is tensioned with cables 98 preferably having a permanent preload established thereacross. Distributor pallet 20 is allowed to cool thereby locking tensile member 26 in place between upper and lower decks 22 and 24. Distributor pallet 20 is then removed from thermoforming device 148.

When a load, such as boxes 32, is placed upon load pallet 30, forces are transferred through legs 42, 44 and 46 of load pallet 30 to peripheral posts 130 and central post 132 on upper deck 22. Posts 130 and 132, in turn, pass a portion of the load to peripheral posts 134 and 136.

If distributor pallet 20 is edge supported by a rack beneath only lateral edge portions 56, central span 60 of body 28 will bend or sag downwardly. As body 28 of distributor pallet 20 deflects, body 28 bears upon central ring 94. The sagging increases the relative distances between peripheral posts 130 and 134 and central posts 132 and 136. As tensile member 26 is preferably already preloaded in tension, this sagging induces further elongation of cables 98. Cables 98, if made of steel, have a relative high modulus of elasticity. Accordingly, flexible member 26 is highly resistant to axial elongation thereby resisting the sagging or vertical deflection of central span 60. Also, as steel is less susceptible to creep than plastic at temperatures of 80–120° F., any creep occurring in the steel cables is negligible. Because of the mesh configuration of tensile member 26, distributor pallet 20 is resistant to creep and deflection whether simply supported along lateral edge portions 56 or along longitudinal edge portions 54.

Figure 10:
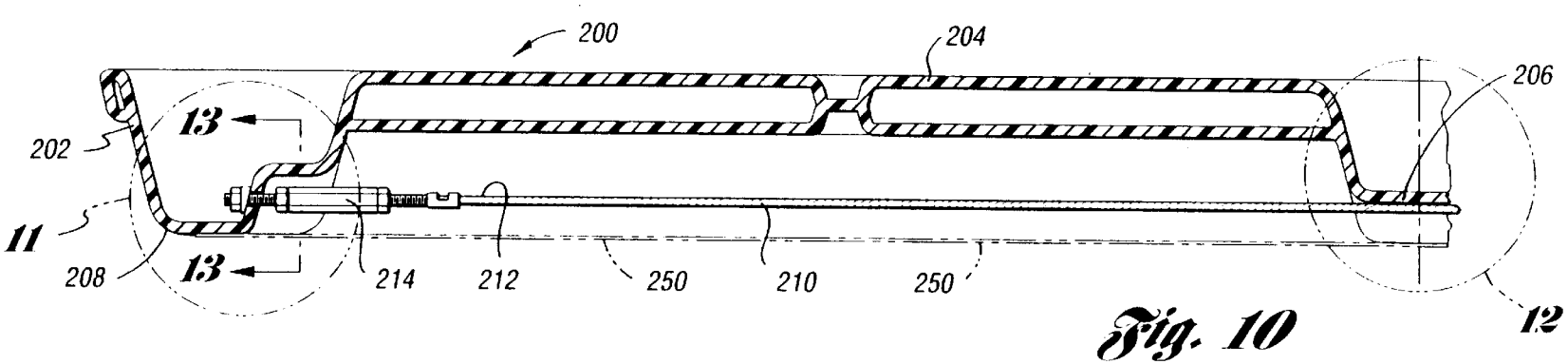
FIG. 10 is a side sectional view of an alternative embodiment of a pallet which is retrofitted with a tensioner and cable in full line and, shown in broken line, retrofitted with a plastic strap.

FIG. 10 shows a portion of an alternative embodiment of a load pallet 200. Pallet 200 includes a pair of lateral edge portions 202 (one shown) connected to a central span 204. Only half of pallet 200 is shown as the other half is generally symmetrical about the centerline of pallet 200. At the center of pallet 200 is a central leg 206 which serves as a fulcrum. Lateral edge portion 202 includes a peripheral leg 208 which depends downwardly from central span 204.

Figure 11:
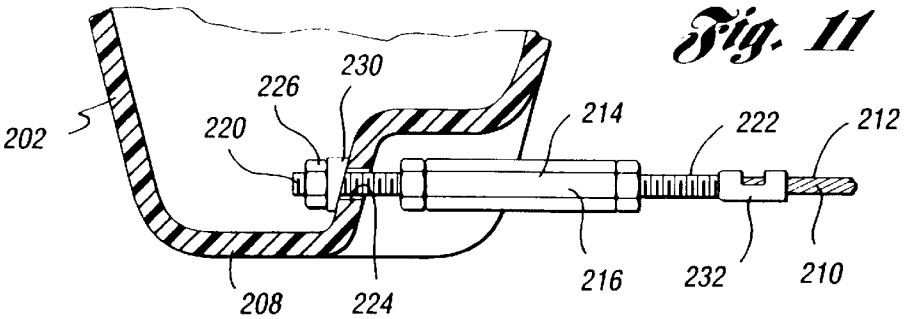
FIG. 11 is an enlarged fragmentary view of the encircled area 11 of FIG. 10.
Figure 13:
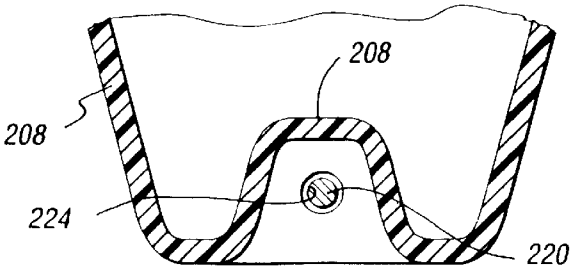
FIG. 13 is an enlarged view taken along line 13—13 of FIG. 10.

A cable 210 has a first end portion 212 affixed to lateral edge portion 202 using a tensioner 214, in this case, a turnbuckle. Likewise, a second end portion is anchored (not shown) on the opposite lateral edge portion of pallet 200. It is contemplated that wall anchoring devices could be used to affix cable 210 to pallet 200. Tensioner 214, shown in greater detail in FIGS. 11 and 13, includes a threaded body 216 threadedly receiving threaded rods 220 and 222 at its opposing ends. Threaded rod 220 extends through an aperture 224 in peripheral leg 208 and is captured by a threaded fastener 226 and washer 230. Threaded rod 222 attaches by way of a crimping collar 232 to cable 210. By rotating body 214 relative to pallet 200, the tension or preload in cable 210 can be adjusted. Alternatively, fastener 226 can be tightened upon threaded rod 222 to vary the tension in cable 210. Note, cable 210 and tensioner 214 can be readily installed and removed from the body of pallet 200.

Figure 12:
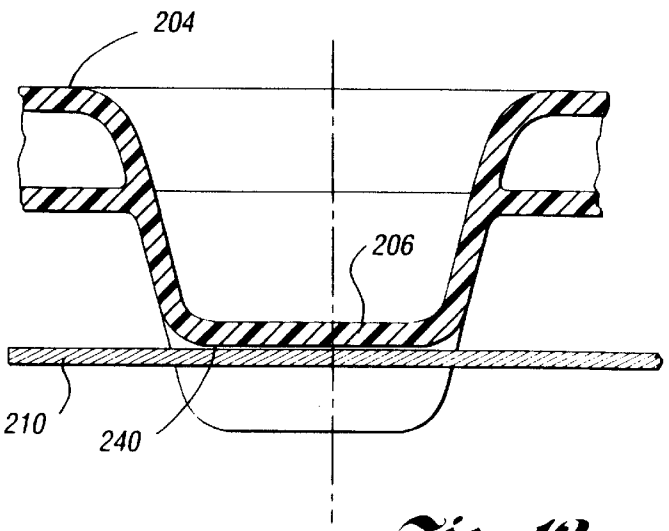
FIG. 12 is an enlarged view of the encircled area 12 of FIG. 10.

FIG. 12 illustrates that central leg 206 has a channel 240 therein for allowing cable 210 to pass through central leg 206. Channel 240 also provides a bearing area for cable 210 to bear against. When central span 204 deflects downwardly due to a load, channel 240 bears upon cable 210 causing cable 210 to deflect downwardly relatively to supported lateral edge portions 202. This causes cable 210 to stretch or axially elongate. Because of the high modulus of elasticity of the steel cable 210, cable 210 resists the elongation and reinforces central span 204 against deflection.

Another method for reinforcing pallet 200 is simply to thermal bond a high tensile strength strap 250 of thermoplastic material to lateral edge portions 202. Strap 250 is shown in phantom line in FIG. 10. A thermal bond or weld may be created using techniques such as sonic or vibration welding, or else with the use of electromagnetic heating or simply using a heat staking process.

In summary, this invention provides a method for retrofitting existing pallets. One or more tensile members can be anchored to one lateral side of a pallet. Then the tensile member is run beneath the pallet, preferably stretched and affixed to the other lateral side of the pallet. When a load is placed on top of the pallet, the central span of the pallet will deflect downwardly. In turn, the tensile member will resist axial elongation thereby taking a portion of the bending tensile load off the bottom fibers of the pallet and reducing the overall deflection of the pallet.

Figure 15:
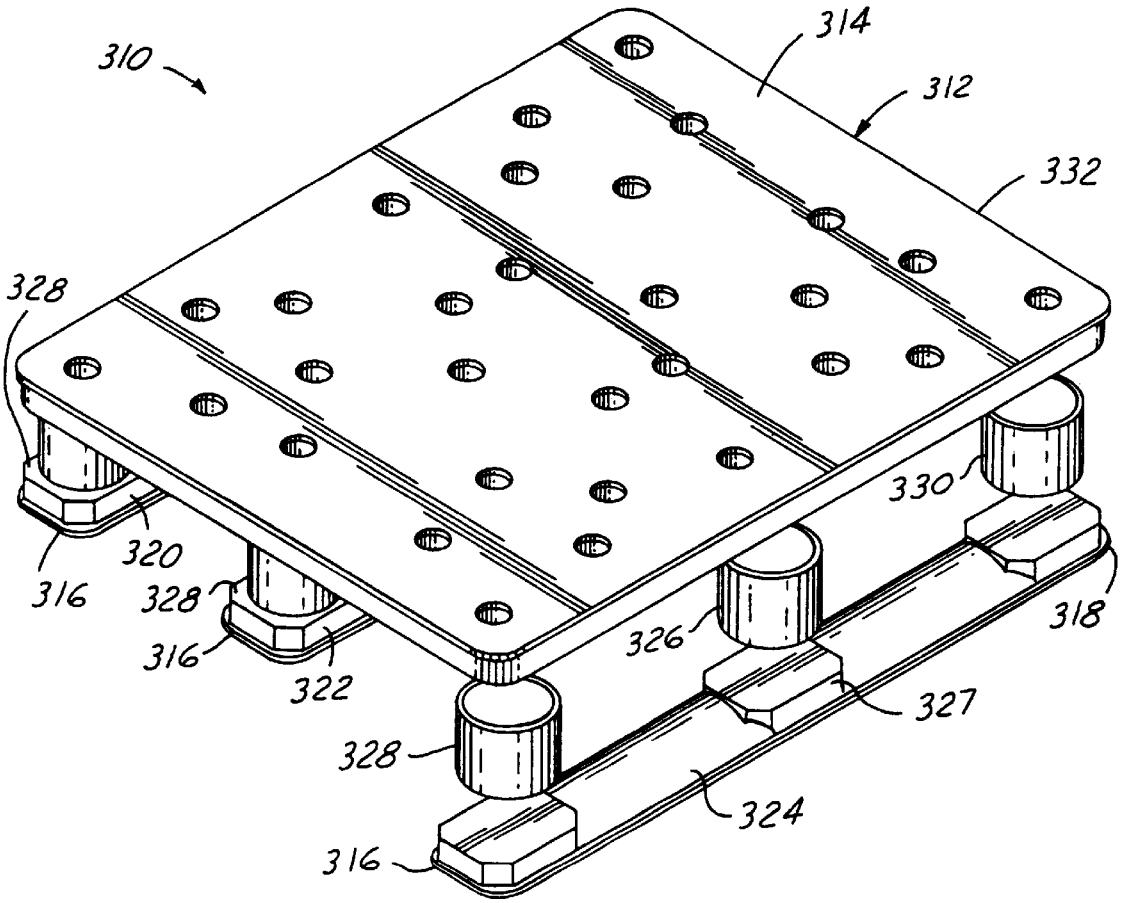
FIG. 15 is a partially exploded perspective view of a pallet in accordance with a second alternative embodiment of the invention.
Figure 16:
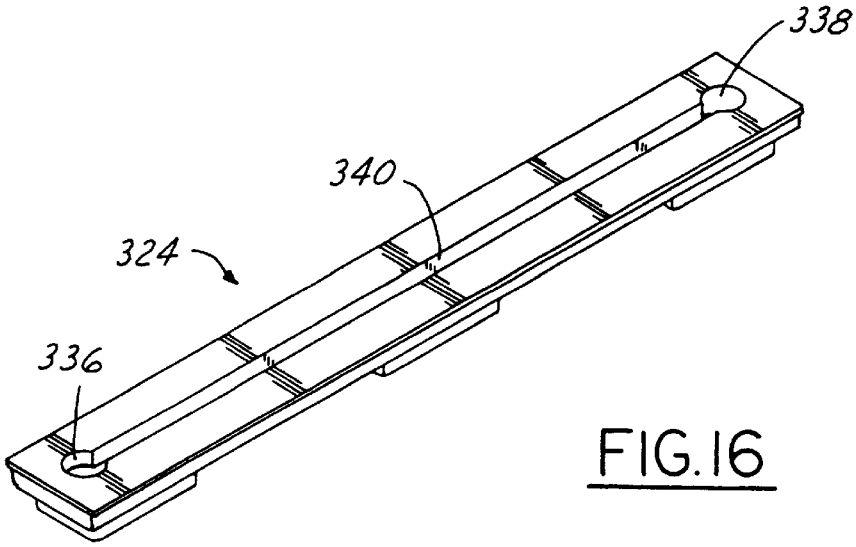
FIG. 16 shows an underside perspective view of a stringer corresponding with the embodiment of FIG. 15.

Referring to FIGS. 15 and 16, a second alternative embodiment is shown in accordance with the present invention. The pallet 310 shown in FIG. 15 includes a multicomponent body 312, which has an upper surface 314 for supporting objects thereon. The body 312 includes a pair of laterally spaced apart edge portions 316,318, which are formed by the stringers 320,322,324. Attached to each stringer 324 is a central support portion 326 and end support portions 328,330 for attachment to the planar portion 332 of the base 312.

As shown in FIG. 16, each stringer 324 forms a pair of attachment points 336,338 for attachment of opposing distal ends of a flexible tensile member, such as those described previously with respect to FIGS. 1–13, or any like embodiment. This stringer 324 also includes an elongated channel 340 for receiving the flexible tensile member. Preferably, the flexible tensile member is attached to the body 312 only at the attachment points 336,338, however a central attachment (or more than one attachment) may also be provided, as shown in FIG. 8. In such various embodiments, the flexible tensile member is substantially unrestrained between the attachment points to allow movement for tension and flexion.

In this configuration, when a load is placed atop the pallet 310 with the pallet 310 being supported along the pair of laterally spaced apart edge portions 316,318, the central support portion 326 (and the central support portion 327 of the stringer 324) will deflect and bear upon the flexible tensile member with the flexible tensile member providing support to the central support portion 326,327 against deflection, as described previously with respect to the various alternative embodiments. It is understood that the central support portion 326,327 described above may be any such supporting structure which protrudes downwardly away from the top surface 314 of the pallet 310. Such structure may comprise the central portion of a central span, as described in previous embodiments, or any like structure. It is further understood that the central support portion need not be in the center of the part, but may vary therefrom. The opposing distal ends of the flexible tensile member may be secured to the attachment points 336,338 by any known means, such as bolting, heat staking, thermoforming, etc.

It is contemplated that the flat portion 332 of the base and the stringers 320,322,324 may be formed by thermoforming sheets together, injection molding, rotational molding, etc.

Figure 17:
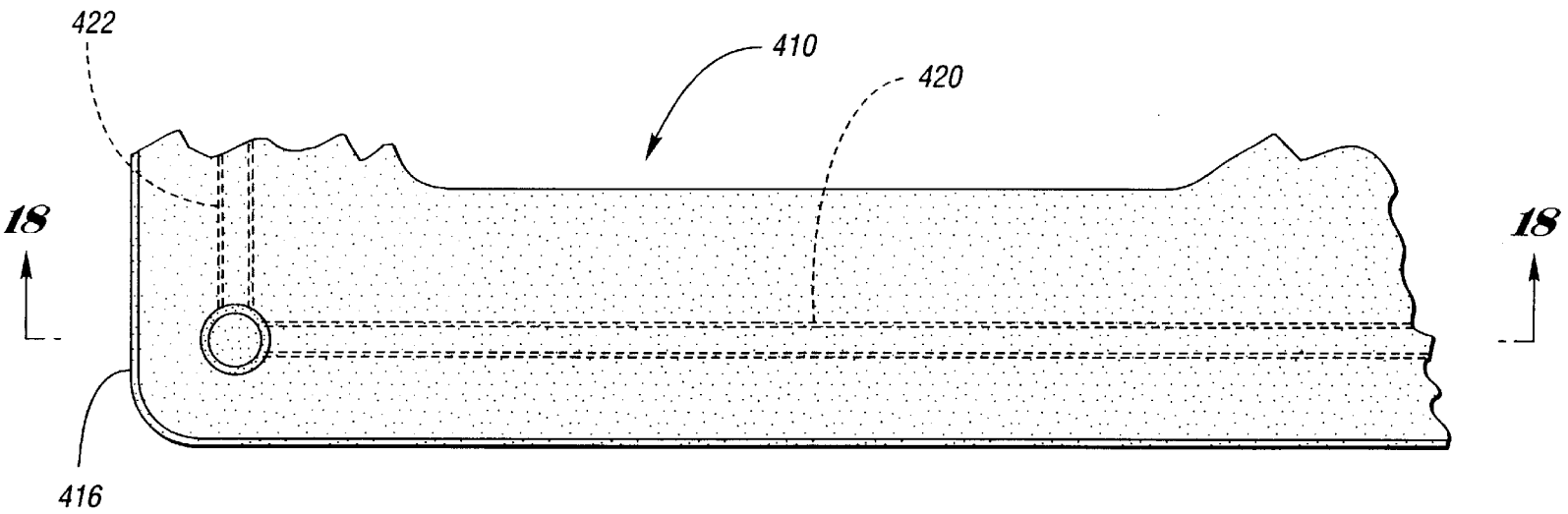
FIG. 17 shows a cut-away plan view of a pallet in accordance with a third alternative embodiment of the invention.
Figure 18:
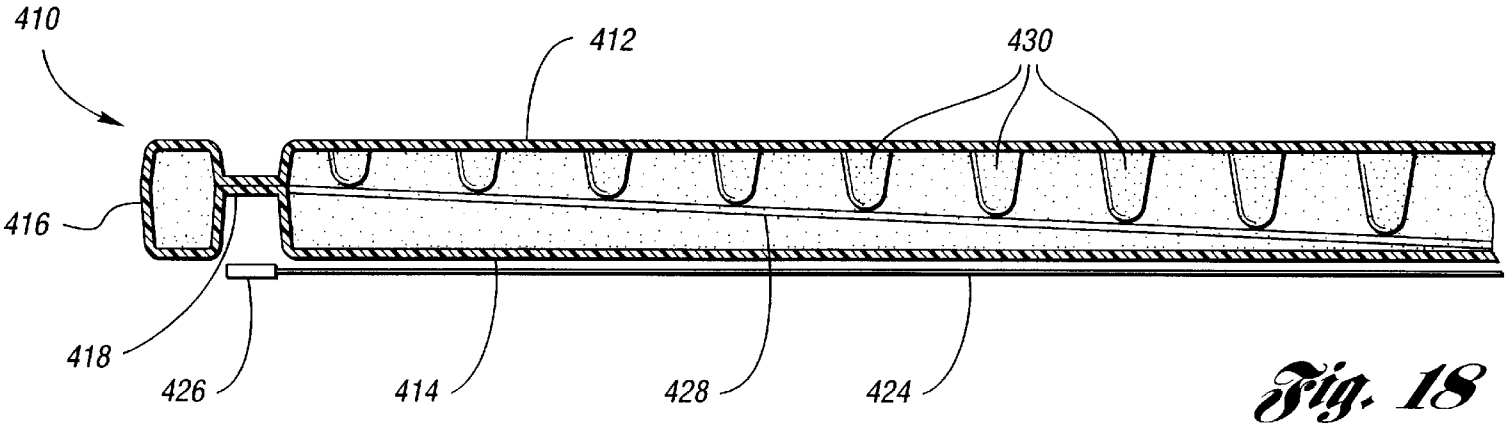
FIG. 18 shows a partially-exploded cut-away sectional view taken at line 18—18 of FIG. 17.

Referring to FIGS. 17 and 18, a third alternative embodiment of the invention is shown. The pallet 410 includes an upper surface 412, a lower surface 414, an edge portion 416, and an attachment point 418. Elongated channels 420,422 are formed in the pallet 410 (much like the elongated channel 340 described with reference to FIG. 16) for receiving the flexible tensile member 424. The distal end 426 of the flexible tensile member 424 is secured to the attachment point 418 by a bolt, rivet, heat staking operation, or other known method.

The channel 420 includes an arced groove 428 having an effective arc length which is preferably 2% to 5% longer than the distance between opposing distal ends 426 of the flexible tensile member 424 for pretensioning the flexible tensile member 424. In this configuration, with the flexible tensile member 424 engaged in the arced groove 428, the flexible tensile member 424 is pretensioned due to the effective arc length as the opposing distal ends 426 of the flexible tensile member 424 are secured to the attachment points 418 of the pallet 410.

As shown in FIG. 18, a plurality of integral fusion points 430 are provided within the channel 420 for structural support. Such integral fusion points are described in detail in U.S. Pat. No. 5,407,632, which is hereby incorporated by reference. The integral fusion points 430 prevent separation of the channel 420 when large forces are applied to the pallet.

Referring to FIG. 17, the additional channel 422 is provided such that an additional flexible tensile member may be secured therein to provide multidirectional support for the pallet 410.

While in the foregoing specification this invention has been described in relation to a certain preferred embodiment thereof, and many details have been set forth for the purpose of illustration, it will be apparent to those skilled in the art that the invention is susceptible to alteration and that certain other details described herein can vary considerably without departing from the basic principles of the invention. For example, while tensioners may include turnbuckles and fasteners, other methods and devices for tensioning tensile members are considered within the scope of this invention. Further, other methods of affixing flexible tensile members to the body of pallets, such as by adhesively securing, are also within the scope of this invention.

What is claimed is:

1. A pallet for supporting objects thereon, the pallet comprising:

a body including an upper surface, a pair of laterally spaced apart edge portions, a pair of attachment points spaced from the upper surface adjacent said pair of edge portions respectively, and a central support portion spaced from the upper surface between said attachment points;

a flexible tensile member having high axial tensile strength and comparatively negligible compressive axial strength secured at opposing distal ends thereof to said pair of attachment points and substantially unrestrained therebetween to allow movement for tension and flexion;

wherein when a load is placed atop the pallet with the pallet being supported along the pair of laterally spaced apart edge portions, the central support portion will deflect and bear upon the flexible tensile member with the flexible tensile member providing support to the central support portion against deflection; and wherein an elongated channel is formed in the body for receiving said flexible tensile member, said channel including a groove configured for engagement along the length of the flexible tensile member, said groove having an effective arc length approximately two percent to five percent greater than the length of the flexible tensile member for tensioning the flexible tensile member.

2. The pallet of claim 1, wherein said body comprises multiple components.

3. The pallet of claim 1, wherein said body includes at least one stringer extending between said laterally spaced edge portions and having a bottom surface, said stringer forming said pair of attachment points, and said stringer forming an elongated channel therein for receiving the flexible tensile member in a position recessed from said bottom surface.

4. The pallet of claim 3, wherein said central support portion comprises a central portion of said stringer.

5. A pallet for supporting objects thereon, the pallet comprising:

a body including an upper surface formed on an upper sheet and a lower surface formed on a lower sheet, a pair of laterally spaced apart edge portions, a pair of longitudinally spaced apart edge portions, and a central span extending between the laterally spaced apart edge portions, said upper and lower surfaces being spaced apart, and said upper and lower sheets being joined at a plurality of knit points;

a flexible tensile member suspended laterally across the body;

wherein when a load is placed atop the pallet with the pallet being supported along the laterally spaced apart edge portions, the central span will deflect and bear upon the flexible tensile member with the flexible tensile member providing support to the central span against deflection; and an elongated channel formed in the body for receiving said flexible tensile member, said channel including a groove configured for engagement along the length of the flexible tensile member, said groove having an effective arc length approximately two percent to five percent greater than the length of the flexible tensile member for tensioning the flexible tensile member.

6. The pallet of claim 5, wherein said flexible tensile member is positioned between said upper and lower sheets.

7. The pallet of claim 5, wherein said flexible tensile member is positioned below said upper and lower sheets.

* * * * *